United States Patent [19]

Küpper

[11] Patent Number: 4,571,931

[45] Date of Patent: Feb. 25, 1986

[54] SPINNING AND WINDING PLANT

[75] Inventor: Wilhelm Küpper, Wegberg, Fed. Rep. of Germany

[73] Assignee: W. Schlafhorst & Co, Moenchengladbach, Fed. Rep. of Germany

[21] Appl. No.: 673,020

[22] Filed: Nov. 19, 1984

[30] Foreign Application Priority Data

Nov. 19, 1983 [DE] Fed. Rep. of Germany ..... 3341895

[51] Int. Cl.[4] ..... D01H 9/00; D01H 9/18; B65H 54/22

[52] U.S. Cl. ..... 57/281; 57/270; 57/276; 198/347; 198/570; 209/552; 209/927; 242/35.5 A

[58] Field of Search ..... 57/266, 270, 274, 273, 57/276, 281, 1 R; 242/35.5 R, 35.5 A; 209/552, 927; 198/347, 570–572, 576

[56] References Cited

U.S. PATENT DOCUMENTS

| | | | |
|---|---|---|---|
| 3,195,298 | 7/1965 | Furst | 242/35.5 R X |
| 3,410,406 | 11/1968 | Tsuda et al. | 57/281 X |
| 3,480,128 | 11/1969 | Brouwer et al. | 242/35.5 R X |
| 3,608,293 | 9/1971 | Brouwer | 57/281 |
| 4,041,686 | 8/1977 | Inaba et al. | 57/281 |
| 4,432,198 | 2/1984 | D'Agnolo | 57/276 |

*Primary Examiner*—John Petrakes

*Attorney, Agent, or Firm*—Herbert L. Lerner; Laurence A. Greenberg

[57] ABSTRACT

A spinning and winding plant includes at least one ring spinning machine, at least one winding machine, at least one first spool conveyor and at least one first tube sleeve conveyor disposed at the ring spinning machine, at least one second spool conveyor and at least one second tube sleeve conveyor disposed at the winding machine, at least one spool transfer station disposed between the first and second spool conveyors, at least one tube sleeve transfer station disposed between the first and second tube sleeve conveyors, a spool storage device with a predetermined number of storage locations at the spool transfer station, a device for emptying the spool storage device in sequence with the requirement for spools at the winding machine, a device for filling a given maximum number of the storage locations with spools supplied by the ring spinning machine, and a device for filling a minimum number of the storage locations with at least partly filled spools ejected and returned from the winding machine.

17 Claims, 9 Drawing Figures

SPINNING AND WINDING PLANT

The invention relates to a spinning and winding plant including at least one ring spinning machine, at least one winding machine, at least one spool conveyor and at least one tube sleeve conveyor at the ring spinning machine as well as at the winding machine, at least one spool transfer station between the spool conveyors, and at least one tube sleeve transfer station between the tube sleeve conveyors.

Modern winding machines are constructed in such a way that the feed spools or creel bobbins coming from the ring spinning machine in the form of bobbins or cops are completely rewound if possible. It is only rarely that some windings are left on the tube sleeves. The number of spools ejected from the winding machine is very small compared to the total number of feed spools which are to be rewound. Modern thread-joining methods, for instance splicing, have contributed to this improvement of the winding operation. For this reason, it is not economically justifiable to provide complex additional devices at a spinning and winding plant, for the sole purpose of preparing the few still wound tube sleeves, which sporadically occur for rewinding within the great number of tube sleeves ejected by the winding machine, and of transporting them back to the winding machine after the preparation.

It is accordingly an object of the invention to provide a spinning and winding plant which overcomes the hereinaforementioned disadvantages of the heretofore-known devices of this general type, and to provide simple means for inserting the fully or partly wound feed spools or creel bobbins which were ejected from the winding machine, back into the circulation of spools delivered from the ring spinning machine, so that an orderly operation of the spinning and winding plant is guaranteed.

With the foregoing and other objects in view there is provided, in accordance with the invention, a spinning and winding plant, comprising at least one ring spinning machine, at least one winding machine, at least one first spool conveyor and at least one first tube sleeve conveyor disposed at the ring spinning machine, at least one second spool conveyor and at least one second tube sleeve conveyor disposed at the winding machine, at least one spool transfer station disposed between the first and second spool conveyors, at least one tube sleeve transfer station disposed between the first and second tube sleeve conveyors, a spool storage device with a predetermined number of storage locations at the spool transfer station, means for emptying the spool storage device in sequence, time or rhythm with the requirement for feed spools or creel bobbins at the winding machine, means for automatically filling a given maximum number of the storage locations with spools supplied or produced by the ring spinning machine, and means for filling a minimum number of the storage locations with full or partly filled spools ejected and returned or delivered back from the winding machine.

In accordance with another feature of the invention, the the spool storage device is in the form of a controllable circulating magazine in which the storage locations are disposed.

The spool storage device or magazine has enough storage locations available to accept the ejected spools accumulated over a given period of time, and the spools can be placed into the magazine by hand during an inspection operation. The spool transfer of the spool magazine is not delayed by this operation.

In accordance with a further feature of the invention, the first spool conveyor of the ring spinning machine includes a device for inserting thread ends into tube sleeves.

In accordance with an additional feature of the invention, there is provided a spool transfer device disposed at the spool transfer station including a device for inserting thread ends into tube sleeves.

In accordance with an added feature of the invention, the circulating magazine includes a device for inserting thread ends into tube sleeves.

In accordance with still another feature of the invention, the means for filling a maximum number of storage locations are in the form of a spool returning device for the full or partly filled spools ejected from the winding machine, the spool returning device being disposed between the spool transfer station and the tube sleeve transfer station.

In accordance with still a further feature of the invention, the spool returning device is connected to the tube sleeve transfer station.

In accordance with still an additional feature of the invention, the spool returning device includes a spool sorting device for sorting feed spools or creel bobbins ejected from the winding machine.

In accordance with still an added feature of the invention, the spool returning device includes a collection container disposed at a given height which is easily accessible to a person monitoring the plant.

In accordance with again another feature of the invention, there is provided a tube sleeve clearing device disposed in vicinity of the spool returning device.

In accordance with again a further feature of the invention, the tube sleeve clearing device includes a thread removal or stripping device.

In accordance with again an additional feature of the invention, the tube sleeve clearing device includes a withdrawal drum.

In accordance with a concomittant feature of the invention, there is provided a suction device having a suction nozzle in vicinity of the spool returning device.

Other features which are considered as characteristic for the invention are set forth in the appended claims.

Although the invention is illustrated and described herein as embodied in a spinning and winding plant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
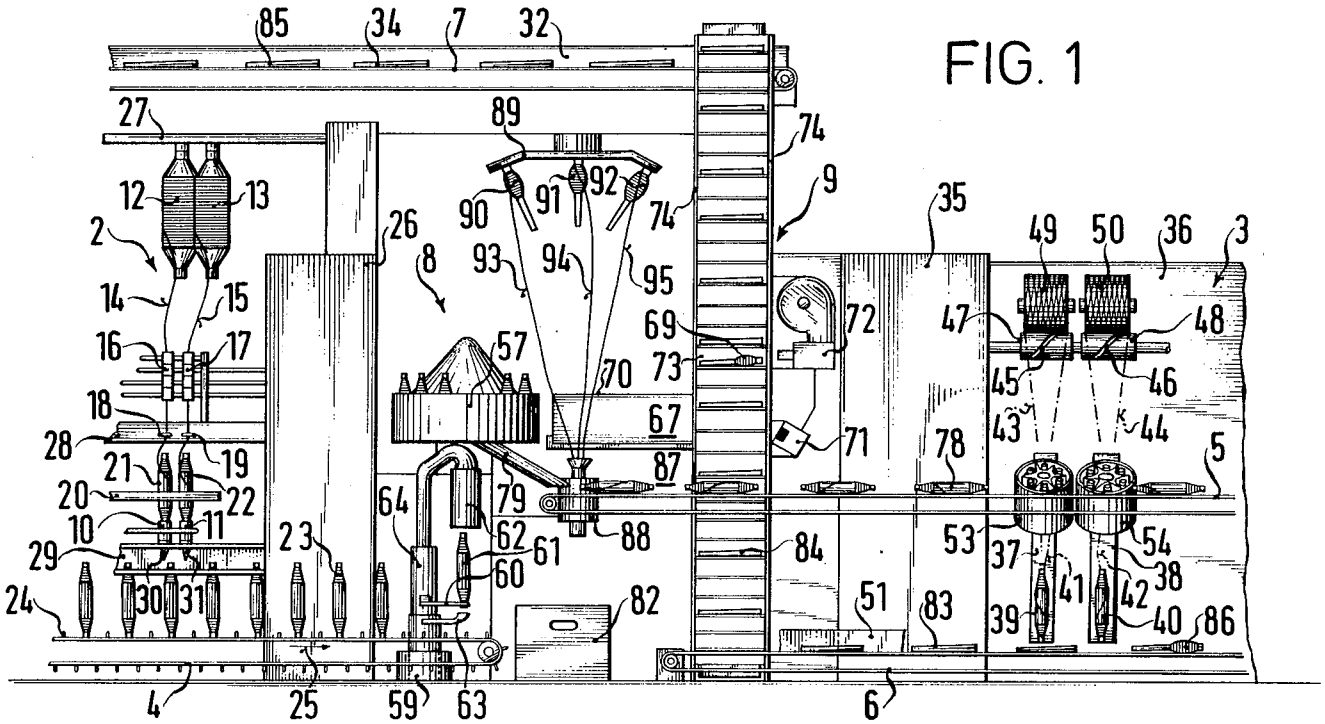
FIG. 1 is a fragmentary, diagrammatic, front-elevational view of the spinning and winding plant of the invention.
Figure 2:
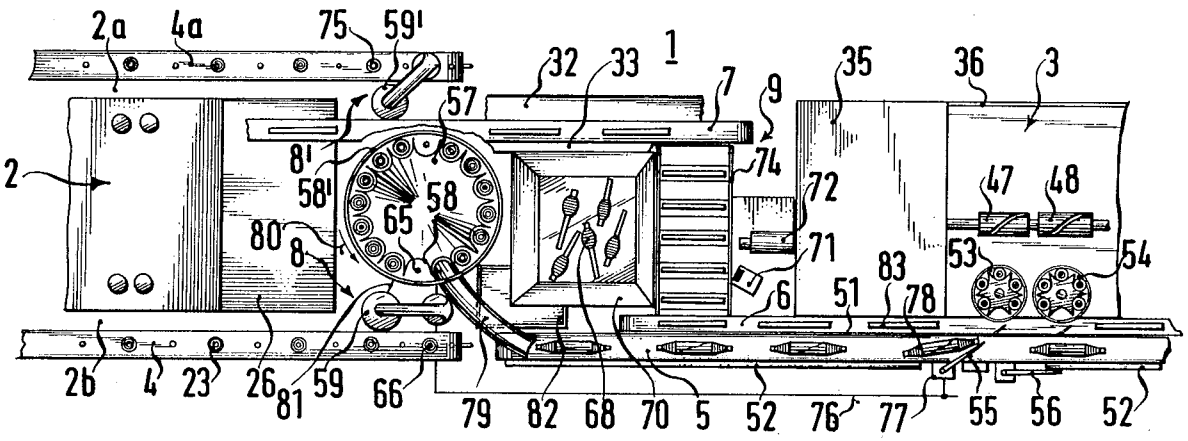
FIG. 2 is a fragmentary top-plan view of the plant.

Referring now to the figures of the drawings in detail, and first particularly to FIGS. 1 and 2 thereof, there is seen a spinning and winding plant which is designated as a whole by reference symbol 1. The plant includes a ring spinning machine or frame 2, a winding machine 3, a spool conveyor 4 at the ring spinning machine, a spool conveyor 5 and a tube sleeve conveyor 6 at the winding machine, a tube sleeve conveyor 7 at the ring spinning machine, a spool transfer station 8 disposed between the conveyors 4 and 5, and a tube sleeve transfer station 9, disposed between the tube sleeve conveyors 6 and 7. Although ring spinning machines or frames 2 are provided at numerous spinning stations, only two spinning stations 10 and 11 are shown. Two rovings or slivers 14 and 15 are conducted from two roving bobbins 12 and 13 through two drafting or drawing systems 16 and 17, through two eyelets 18 and 19, and through a ring traveler which is covered by a ring rail 20, to two spools 21 and 22 which form the spinning bobbins or cops. Previously manufactured bobbins or spools 23 are disposed on the spool conveyor 4. The conveyor 4 is provided with pins 24, so that the conveyor is able to advance in the direction of an arrow 25 in steps of one spool per division after receiving a control command. An end frame 26 of the ring spinning frame 2 serves as a support for various cross members 27, 28, 29, and also houses the drives of the drawing frames of the ring rail and of spindles 30 and 31.

The tube sleeve conveyor 7 is constructed in the form of a transporting belt which is disposed overhead along the ring spinning machine 2. The conveyor 7 has a working surface which is bordered by side walls 32, 33 in such a way that tube sleeves 34 orient themselves in a longitudinal position, and remain oriented that way.

In FIG. 1 an end frame 35 and a rear wall 36 of the winding frame or machine 2 are shown. Although a total of ten winding stations are provided, only two winding stations 37 and 38 are illustated. Threads 41, 42 coming from the feed spools or creel bobbins 39, 40, form traverse motion triangles 43, 44 and are conducted through reverse thread grooves 45, 46 of two winding drums 47, 48 to cheeses or cross-wound bobbins 49 and 50 which are produced by and driven by the winding drums.

The replacement of feed spools is effected by the spool conveyor 5 which is constructed as a flat transport belt with side walls 51, 52. At each winding station 37 and 38, a circular magazine 53, 54 is provided so that a limited amount of feed spools is stored. The feed spools are replenished by moving a deflector 55, 56 in the path of the spool conveyor 5, in order to direct a spool into the respective circular magazine.

FIG. 2 shows that the ring spinning machine 2 is constructed in a double-sided form. The front side of the machine is designated by reference symbol 2*b* and the rear machine side is indicated by reference symbol 2*a*. A spool conveyor 4*a* is also provided at the rear side of the machine, which is constructed exactly the same as the conveyor 4 and is at the same level as the conveyor 4.

The spool transfer station 8 is provided with a spool storage device 57 which is constructed as a circular magazine and discharges spools in time with the requirement of the winding machine 3. The magazine 57 has a total of 16 predetermined storage positions 58, 58'.

A spool transfer device 59 is disposed at the spool transfer station 8. The spool transfer device 59 includes a spool gripper 60, and a device for inserting the thread end into the tube sleeve of the respective spool 61 held by the gripper 60. The inserting device is formed of a suction bonnet 62 positioned above the spool 61 and a suction tube 63 having an end below the spool 61. A three-step telescoping device 64 can raise the suction tube 63 up to the height of the lower edge of the spool magazine 57. The same telescoping device raises the spool gripper 60 far enough so that the spool 61 enters the suction bonnet 62. If suction is applied to the suction bonnet 62, the thread end of the spool is picked up by the suction air and pulled above the head of the spool. The spool gripper 60 can be lifted up to the height of the upper edge of the spool magazine 57, so that the suction bonnet 62 is automatically taken along. The spool transfer device 59 can also pivot, so that the suction tube 63 is moved toward the magazine 57, and the spool 61 is positioned exactly above the storage position 58. If the gripper 60 opens at this point, the spool 61 drops into the storage position 58. If suction is applied to the suction tube 63 at this moment, the suction air acts on the tube sleeve of the spool 61 through an opening 65 formed in the bottom of the storage location 58, so that the thread end which was previously sucked-in by the suction bonnet 62 is now sucked into the tube sleeve of the spool 61, and remains there. The suction supply is then cut off, and the spool transfer device 59 returns to its starting position shown in FIG. 2.

If a spool 66 shown in FIG. 2 is to be subsequently transported into the spool magazine 57, the gripper 60 is also lowered by the telescoping device 64 toward the foot of the tube sleeve, grabs the foot, and pulls the spool 66 upward from the pin of the conveyor 4, and moves back again to its starting position. The work cycle which was already described is then repeated. It can thus be seen that the suction bonnet 62 and the suction tube 63 together form a device for inserting the thread end into the sleeve.

A spool retuning device is disposed between the spool transfer station 8 and tube sleeve transfer station 9. The spool returning device, which as a whole is designated with reference symbol 67, serves the function of returning full or partly wound bobbins 68, 69 which were ejected from the winding machine 3.

The spool returning device 67 is connected with the tube sleeve transfer station 9, and has a collection container 70. The spool returning device 67 is provided with a spool sorting device for sorting the feed spools 69 which have been ejected from the winding machine 3. The spool sorting device is formed of an opto-electric sensor 71 and a blowing device 72 which is controlled by the opto-electric sensor. The opto-electric sensor responds whenever a spool is rejected by the winding machine, and gives a time delayed signal to the blowing device 72, which then blows the respective feed spool 69 from a transporting compartment 73 of a spool elevator 74 into the collection container 70.

FIG. 2 shows that the rear side 2*a* of the machine 2 has an additional spool transfer station 8' with a spool transfer device 59'. The spool transfer device 59' is constructed exactly the same as the spool transfer device 59 with a mirror-image construction. The spool transfer device 59' serves the function of transporting the spools 75 on the conveyor 4a to the storage location 58'. The combination spinning and winding plant 1 according to the invention operates as follows:

The spools of the machine side 2b are always transported to the winding machine 3, and only thereafter are the spools of the other machine side 2a transported. It is assumed that the spool conveyor 4a of the machine side 2a and the spool transfer device 59' are stopped. As soon as the storage location becomes available at the winding frame 3, for instance in the circular magazine 53, because a feed spool 39 was discharged from the circular magazine 53, a signal pulse originates from the spool winding station 37 through a connection 76 to the drive 77 of the deflector 55. The result is that the next positioned feed spool 78 on the spool conveyor 5 is conducted into an empty storage location of the circular magazine 53. Simultaneously, a pulse is sent to the spool storage device 57 over the same functional connection 76, in order to discharge a spool through a slide 79 onto the continuously moving spool conveyor 5. For this purpose, the circular magazine 57 advances one step in the direction of a curved arrow 80, so that if a spool is positioned in the storage location 58, it is positioned over the slide 79 where an opening is formed in the bottom of the spool storage device. Since the storage location designated with reference symbol 58 in FIG. 2 is vacant, a pulse is transmitted from the storage device 57 over an operative connection 81 to the spool transfer device 59, causing it to take another spool, for instance the spool 66 from the conveyor 4, and to fill it into the storage location 58.

Since the spool transfer device 59 is capable of operating somewhat faster than the average spool requirement of the winding frame 3, as a rule there is always a spool ready in the spool storage device 57.

As shown in FIG. 2, of the total of 16 storage positions in the spool storage device, only two places, i.e. the storage position 58 and the next adjacent position to the right, are available for transferring spools from the conveyor 4 to the conveyor 5. All of the other storage locations 58', i.e. 14 storage locations, are available for returning the spools 69 which are in the full or partly filled state and have been ejected from the winding machine 3. During an inspection operation, the spools collected in the container 70 can be sequentially placed into the free storage locations of the storage device 57 by hand. For this purpose, the ejected spools must be inspected and prepared. These spools which have so little winding left that further rewinding is not economical, are immediately discarded into a waste container 82. The thread end of the still usable spools must be located and inserted into the tube sleeve. After the spool has been prepared in this manner, it can be inserted into a vacant storage location in the spool storage device 57.

Since as a rule only a few spools are ejected from the winding machine 3, there are only the five spools 68 in the collection container 70 as shown in FIG. 2, after an inspection cycle has been completed for 10 units, and a new inspection cycle begins. These few spools are returned to the spool circulation after a short time without interrupting the combined operation of the ring spinning machine 2 and the winding machine 3.

After all of the spools from the spool conveyor 4 of the machine side 2b have been used up, the spools on the conveyor 4a on machine side 2a receive their turn. For this purpose, the spool transfer device 59 is stopped, and the spool transfer device 59' is started. The spool transfer device 59' transports the spools into the storage location designated with reference symbol 58' in FIG. 2. Of the total of 16 storage positions of the storage device 57, eight places are occupied for the spools of the conveyor 4a. The remaining eight storage locations are always available for accepting spools which were ejected from the winding frame 3.

The drawings show that only five spools all together lie on the spool conveyor 5 of the winding machine 3. These are the five spools which were requested from the five winding stations of the winding machine 3.

The drawings also show that besides the ejected tube sleeves 83, a rejected spool 86 lies on the tube sleeve conveyor 6 of the winding machine 3. The spools and the tube sleeves reach the elevator 74. Besides tube sleeves 84, a rejected spool 69 which is blown into the collection container 70 from the transport compartment 73 by means of the blowing device 72 is also present on the elevator 74 at this moment. In contrast, only empty tube sleeves 34, 85 are present on the tube sleeve conveyor 7 of the ring spinning machine 2.

The return of the tube sleeves to the other end of the ring spinning machine 2 need not absolutely be accomplished by a transport band. It is also possible for the upper end of the elevator 74 to have a collection box for tube sleeves, which from time to time can be moved to the non-illustrated tube sleeve mounting device of the spinning machine.

The spool returning device 67 also collects spools which are either damaged or whose further processing is uneconomical, because too little thread is left. These spools can be collected in the waste container 82. However, since spool tube sleeve circulation is occurring, no spools or tube sleeves should be removed from this circulation. For this reason, according to FIG. 1, a tube sleeve cleaning, stripping, or clearing device 87 is provided. The clearing device 87 is disposed in vicinity of the spool returning device 67, and is formed of two parts, i.e. a thread removing device 88 and a runoff frame 89. The runoff frame 89 has three mounting pins onto which spools 90, 91, 92 are mounted. The threads 93, 94, 95 of the spools run into the thread removing or stripping device 88. After the threads are completely removed and sucked off, the empty tube sleeves are returned into circulation at the tube sleeve transfer station 9.

Figure 7:
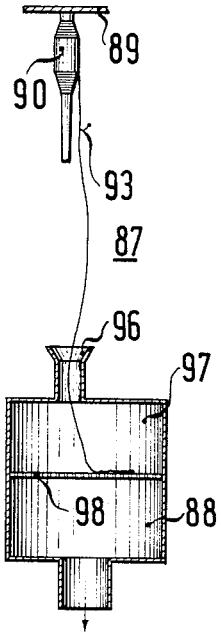
FIGS. 7, 8 and 9 are elevational views of three different embodiments of devices for cleaning tube sleeves.
Figure 8:
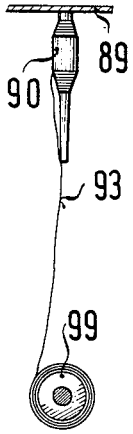
Figure 9:
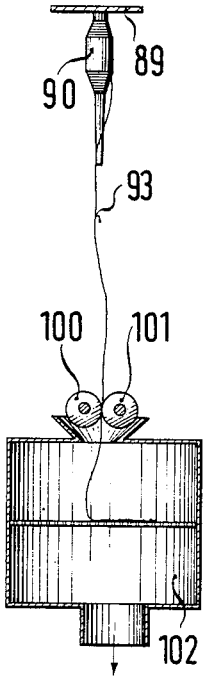

FIGS. 7, 8 and 9 diagrammatically show three specific embodiments of tube sleeve clearing devices. FIG. 7 corresponds to the tube sleeve clearing device 87. In this case, the thread stripping device 88 is constructed in the form of a suction device. The thread 93 passes through a funnel 96 into a chamber 97 to which negative pressure is applied, and in which a bin or sieve 98 is provided which collects the threads. From time to time, the sieve 98 is cleaned out, and the thread is removed.

In the embodiment according to FIG. 8, the thread 93 is wound onto a drum 99 which rotates. In the embodiment according to FIG. 9, the thread 93 is pulled off by a pair of rollers 100, 101. The rollers are followed by a thread suction device 102 which in principle corresponds to the suction device according to FIG. 7.

Rotating thread removal devices are especially recommended for stronger threads. For weaker threads, a pneumatic thread clearing device is sufficient.

Figure 4:
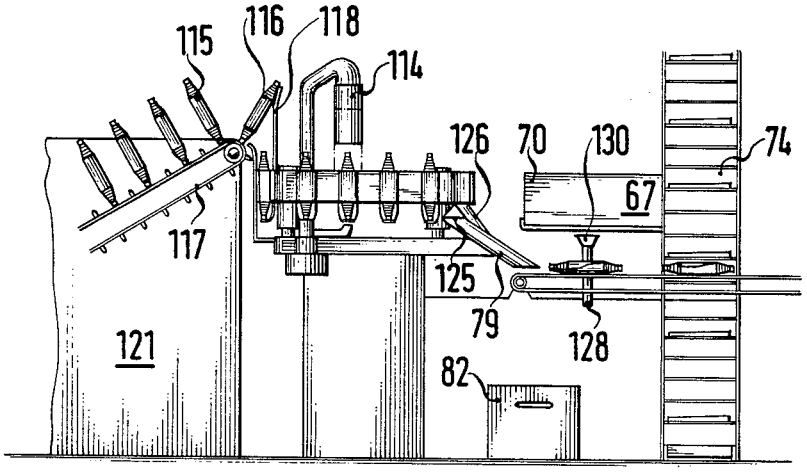
FIG. 4 is a fragmentary, side-elevational view of the spool storage device shown in FIG. 3.
Figure 3:
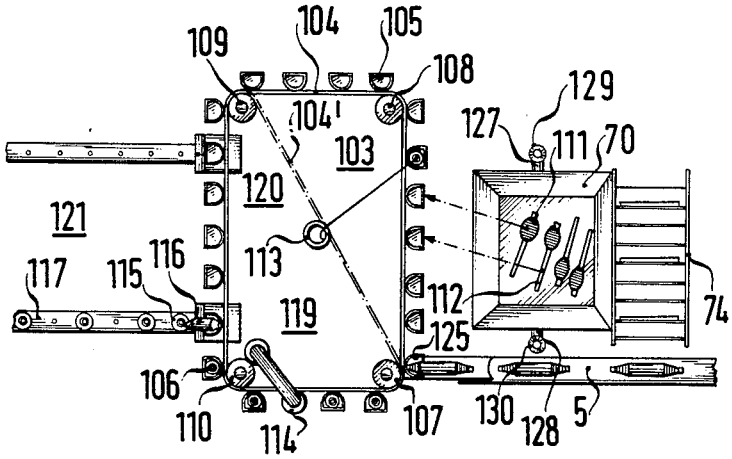
FIG. 3 is a fragmentary top-plan view of another construction of the spool storage device of the plant.

The circular or round magazine 57 of the first embodiment which is used as an example, is only a special form of the circulating magazine according to the invention. For instance, FIGS. 3 and 4 show another construction of the circulating magazine. In FIGS. 3 and 4, the circulating magazine is formed of a vertically disposed transport band 104, which carries pockets 105 for accepting feed spools 106. The drive of the transport band 104 always operates in steps of one division with the aid of a drive roller 107 which is driven in steps. The other three rollers 108, 109 and 110 serve for guiding and deflecting the transport band 104.

The partly wound spools 111 and 112 lying in the collection box 70 can be inserted into the free storage locations of the circulating magazine 103 during an inspection operation, as indicated by arrows. In this way, the thread end is picked out, and held against a suction nozzle 113 of a suction device. The suction nozzle 113 sucks up the thread end, and holds it in position. This method of handling the thread end has two advantages. The thread end need not be pushed into the tube sleeve, and a device 114 for inserting the thread end into the sleeve located at the circulating magazine 103, can find the thread end more easily. The device 114 functions very similarly to the device 62, 63 of the first embodiment, so that its function will not be described in detail at this point. The supply device for finish-wound feed spools 115, 116 in Figs. 3 and 4 is different than in the first embodiment, and the supply is carried out by means of an inclined conveyor band 117. At the upper end of the inclined conveyor 117, the feed spools drop one after the other into a funnel 118 of the spool transfer device which is designated as a whole with reference numeral 119. A second spool transfer device 120 is located at the rear side of the ring spinning machine which is only designated by reference numeral 121. The remaining reference numerals of the parts shown in FIGS. 3 and 4 correspond to the parts with the same numerals in the first embodiment according to FIGS. 1 and 2.

Figure 6:
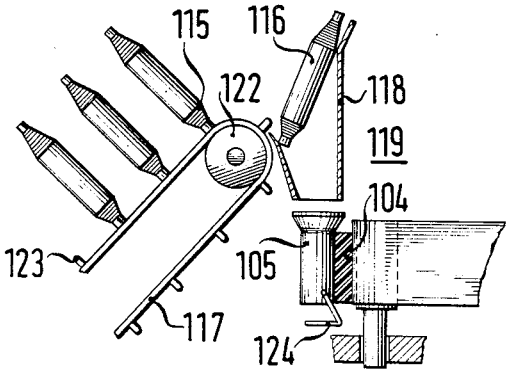
FIG. 6 is an enlarged, fragmentary, side-elevational view showing details of the spool storage device of FIG. 3.

FIG. 6 shows the spool transfer device 119 on a somewhat larger scale. The inclined conveyor band 117 runs over a roller 122 and carries short mounting pins 123 for the sleeves of the feed spools 115, 116. Each pocket 105 of the conveyor band 104 is expanded like a funnel at the top thereof, and is covered by a swing trap 124 at the bottom thereof. The swing trap 124 hits a tripping device 126 at a transfer station designated with reference symbol 125 in FIGS. 3 and 4, and therefore swings to the side and releases the spool.

In FIG. 3 it is indicated that in a different construction, the transport band 104 could take the path 104'. In this case, the conveyor band would be conducted in a triangle instead of a rectangle, and one deflection roller could be omitted. The actual configuration of the circulating magazine is obviously quite variable.

In the embodiment according to FIG. 3 and 4, suction devices 127 and 128 are provided with suction openings 129, 130 in vicinity of the spool returning device 67. With the aid of these suction devices, the endings of the spools 111, 112 accumulated in the collection container 70 can be sucked into the tubes in a simple way. First the end of the thread is found, then the tube sleeve is held over one of the two suction openings 129, 130, releasing the thread ending. The thread ending is then rapidly sucked into the tube sleeve. The spool prepared in this way is then placed into a circulating magazine 103.

Figure 5:
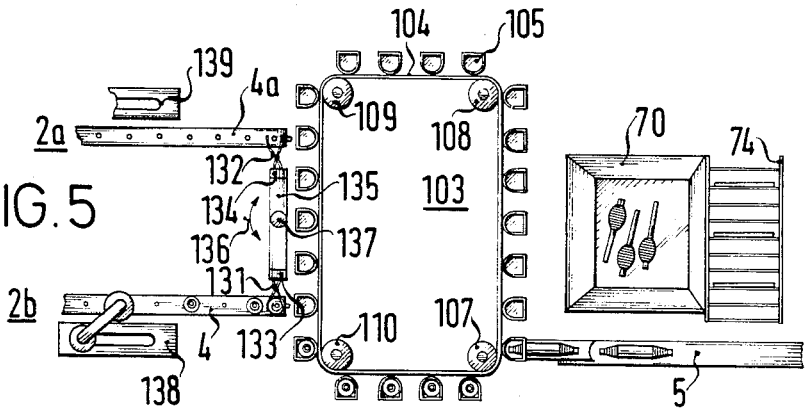
FIG. 5 is a view similar to FIG. 3 of yet another version of the spool storage device.

The embodiment according to FIG. 5 differs in the following details from the embodiment according to FIGS. 3 and 4.

The spool conveyors 4 and **4*a* of the machine sides 2*b* and 2*a* of the ring spinning machine are positioned directly in front of the circulating magazine 103, without the interposition of an inclined conveyor band. Two spool transfer devices 133 and 134 which are disposed at the magazine 103, are provided with grippers 131, 132. The grippers share an operating device 135. While the spool transfer devices 133, 134 with their grippers are capable of grabbing a spool from the conveyor and dropping it into one of the pockets 105 of the circulating magazine 103 at the right moment, the device 135 has the capability of lifting and lowering the spool transfer devices which are connected to it, and of swinging them around a pivot point 137 in the direction of the double arrow 136. Although both spool transfer devices 133, 134 are operated at the same time, only one of them functions at a time. The ring spinning machine is operated in such a manner that finish-wound feed spools are kept ready on either the spool conveyor 4 alone, or on the spool conveyor 4*a*** alone.

Each of the two spool conveyors 4, **4*a* is provided with a device 138, 139 for inserting the thread ending into the tube sleeve. Thus, the feed spools already arrive in a properly prepared manner at the spool transfer devices 133, 134**.

In all of the constructions of the combination spinning and winding plant, the spool storage device, spool elevator and spool returning device with the collection container form a structural unit which can be employed between the spinning machine and the winding machine.

The replenishing of the spool storage device with ejected spools can be accomplished manually from both sides of the machine, so that if the machines are monitored by one person, time and walking are reduced.

The tube sleeve conveyor 7 extends along the length of the spinning machine, so that it also serves as a tube sleeve storage device. The conveyor 7 should always have a certain buffer content of sleeves, since then rejected useless sleeves need not be replaced immediately.

The invention is not limited only to the illustrated and described specific embodiments.

For instance, it would be of advantage to automatically monitor the buffer supply of sleeves at the tube sleeve conveyor 7, and to indicate if a minimum reserve has been reached through the use of a signal.

I claim:

1. Spinning and winding plant, comprising at least one ring spinning machine, at least one winding machine, at least one first spool conveyor and at least one first tube sleeve conveyor disposed at said ring spinning machine, at least one second spool conveyor and at least one second tube sleeve conveyor disposed at said winding machine, at least one spool transfer station disposed between said first and second spool conveyors, at least one tube sleeve transfer station disposed between said first and second tube sleeve conveyors, a spool storage device with a predetermined number of storage locations at said spool transfer station, means for emptying said spool storage device in sequence with the requirement for spools at said winding machine, means for filling a given maximum number of said storage locations with spools supplied by said ring spinning machine, and means for filling a maximum number of said storage locations with at least partly filled spools ejected and returned from said winding machine.

2. Spinning and winding plant according to claim 1, wherein said spool storage device is in the form of a controllable circulating magazine in which said storage locations are disposed.

3. Spinning and winding plant according to claim 2, wherein said circulating magazine includes a device for inserting thread ends into tube sleeves.

4. Spinning and winding plant according to claim 1, wherein said first spool conveyor of said ring spinning machine includes a device for inserting thread ends into tube sleeves.

5. Spinning and winding plant according to claim 1, including a spool transfer device disposed at said spool transfer station including a device for inserting thread ends into tube sleeves.

6. Spinning and winding plant according to claim 1, wherein said means for filling a minimum number of storage locations are in the form of a spool returning device for the at least partly filled spools ejected from said winding machine, said spool returning device being disposed between said spool transfer station and said tube sleeve transfer station.

7. Spinning and winding plant according to claim 6, wherein said spool returning device is connected to said tube sleeve transfer station.

8. Spinning and winding plant according to claim 6, wherein said spool returning device includes a spool sorting device for sorting spools ejected from said winding machine.

9. Spinning and winding plant according to claim 8, wherein said spool returning device includes a collection container disposed at a given height which is easily accessible to a person monitoring the plant.

10. Spinning and winding plant according to claim 6, wherein said spool returning device includes a collection container disposed at a given height which is easily accessible to a person monitoring the plant.

11. Spinning and winding plant according to claim 6, including a tube sleeve clearing device disposed in vicinity of said spool returning device.

12. Spinning and winding plant according to claim 11, wherein said tube sleeve clearing device includes a thread removal device.

13. Spinning and winding plant according to claim 12, wherein said tube sleeve clearing device includes a withdrawal drum.

14. Spinning and winding plant according to claim 12, wherein said tube sleeve clearing device includes a pair of withdrawal rollers.

15. Spinning and winding plant according to claim 12, wherein said tube sleeve clearing device includes a thread suction device.

16. Spinning and winding plant according to claim 12, wherein said tube sleeve clearing device includes a pair of withdrawal rollers and a thread suction device.

17. Spinning and winding plant according to claim 6, including a suction device having a suction nozzle in vicinity of said spool returning device.

* * * * *